US006325499B1

(12) United States Patent
Betschon

(10) Patent No.: US 6,325,499 B1
(45) **Date of Patent: *Dec. 4, 2001**

(54) INK CARTRIDGE FOR A PRINTER

(75) Inventor: Luzius Betschon, Uster (CH)

(73) Assignees: Pelikan Produktions AG (CH); Nu-kote International, Inc.

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/639,337

(22) Filed: Apr. 26, 1996

(51) Int. Cl.[7] ..... B41J 2/175
(52) U.S. Cl. ..... 347/86
(58) Field of Search ..... 347/86, 87, 85, 347/84; 400/124.1

(56) References Cited

U.S. PATENT DOCUMENTS

| | | | | |
|---|---|---|---|---|
| 3,940,807 | * | 3/1976 | Baker et al. | 4/490 |
| 4,771,295 | * | 9/1988 | Baker et al. | 347/87 |
| 5,025,271 | | 6/1991 | Baker et al. . | |
| 5,158,377 | * | 10/1992 | Suzuki et al. | 400/124.1 |
| 5,221,148 | * | 6/1993 | Suzuki et al. | 400/124.1 |
| 5,421,658 | * | 6/1995 | Suzuki et al. | 400/124.1 |
| 5,477,963 | * | 12/1995 | Mochizuki et al. | 347/86 |
| 5,821,965 | * | 10/1998 | Oda et al. | 347/86 |

FOREIGN PATENT DOCUMENTS

| | | | | |
|---|---|---|---|---|
| 529879 | * | 3/1993 | (EP) | 347/87 |
| 0 635 373 A1 | | 12/1993 | (EP) . | |
| 0 624 475 A2 | | 5/1994 | (EP) . | |
| 0 633 138 A2 | | 7/1994 | (EP) . | |
| 0 647 527 A1 | | 10/1994 | (EP) . | |
| 633138 | * | 1/1995 | (EP) | 347/86 |
| 59 143646 | | 8/1984 | (JP) . | |

* cited by examiner

*Primary Examiner*—N. Le
*Assistant Examiner*—Michael P. Nghiem
(74) *Attorney, Agent, or Firm*—Fay, Sharpe, Fagan, Minnich & McKee, LLP

(57) ABSTRACT

An ink cartridge for a printer includes a casing containing a porous ink storage body. A bottom wall of the cartridge casing has an opening therethrough for communication with a print head. An area of the inside face of the bottom wall around the opening has a plurality of grooves that open to the opening. The area is covered by a sieve against which the porous body is held in contact.

18 Claims, 1 Drawing Sheet

INK CARTRIDGE FOR A PRINTER

BACKGROUND OF THE INVENTION

The subject invention is directed toward the art of ink jet printers and, more particularly, to an improved ink storage cartridge for such printers.

Cartridges for ink jet print heads or matrix print heads comprising a casing which contains a porous ink storage body are known from U.S. Pat. Nos. 4,771,295, 5,158,377, 5,221,148, and 5,421,658. A tubular socket of the print head extends into the interior of the casing and locally compresses the porous body. It is assumed that this local compression increases the capillarity of the porous body around the socket so that the ink content of the porous body can be used more completely.

SUMMARY OF THE INVENTION

The object of the present invention is to provide a different way of utilizing the ink content of the porous body as completely as possible. The cartridge of the present invention comprises a housing with a bottom wall containing an opening for connection with the print head. An inside face of the bottom wall has an area around the opening provided with a plurality of grooves that open to the opening. The area is covered by a sieve that overlies the grooves. The housing further contains a porous body which is held in contact with the sieve. Preferably, the grooves extending from the open-like configuration comprise radial grooves extending from the opening and branch grooves extending from at least some of the radial grooves.

With the present invention, the active area of the sieve through which the ink passes when consumed by the print head is considerably increased as compared to the cartridges of the prior art. This substantially reduces the flow resistance of the filter.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment and method of which will be described in detail in this specification and illustrated in the accompanying drawings which form a part hereof, and wherein.

DETAILED DESCRIPTION OF THE PREFERRED EMBODIMENT

Figure 1:
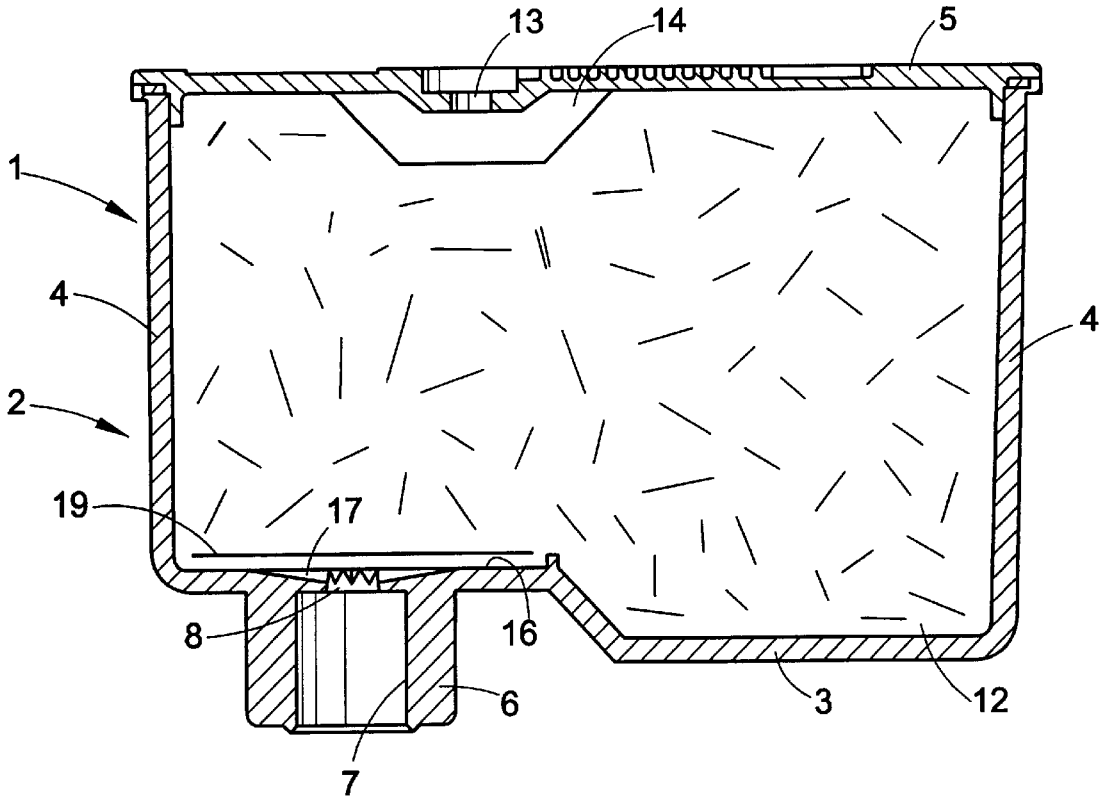
FIG. 1 is a cross section of a cartridge for an ink jet or a matrix print head; and, FIG. 2 is a top view of the cartridge with the cover, porous body, and sieve removed.
Figure 2:
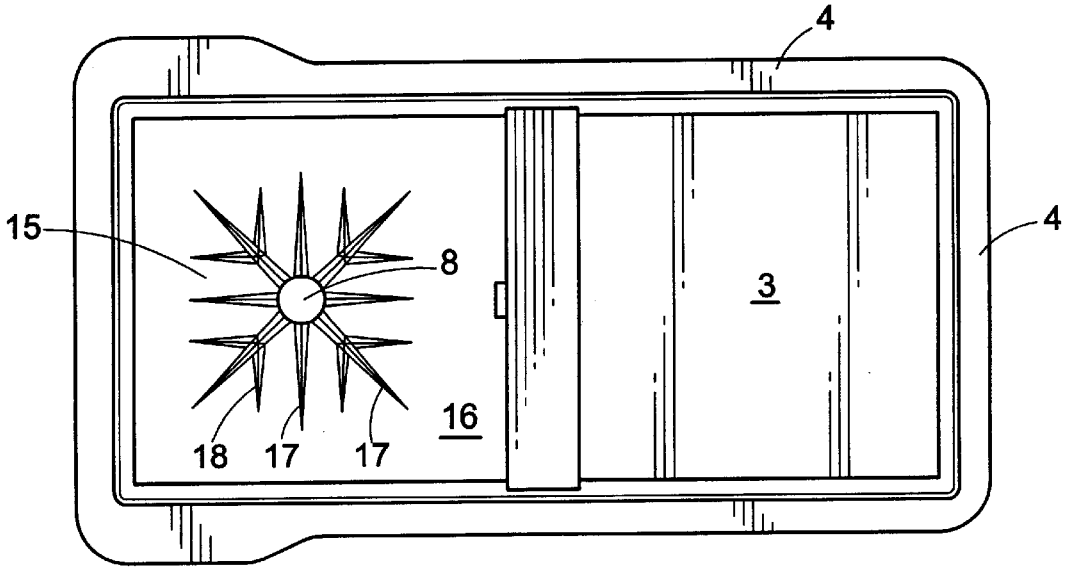

Referring now to the drawings wherein the showings are for the purposes of illustrating the preferred embodiment of the invention only and not for purposes of limiting same, FIG. 1 shows a cross section through the cartridge 1 including a casing 2 comprised of a bottom wall 3, four lateral walls 4, and a cover 5 welded or sealed onto the free edges of the lateral walls 4. A tubular socket 6 with a cylindrical bore 7 fits onto and receives a tubular extension or socket of the print head (not shown). An opening 8 through the bottom wall 3 connects the bore 7 with the interior of the casing 2.

The casing 2 contains a porous body 12 of foamed synthetic material, such as polyethylene, which is slightly compressed by 2% to 6% in a direction perpendicular to the bottom wall 3 and cover 5 over most of their area. The cover 5 has an opening 13 for admitting air to a small recess 14 in the body 12 underneath the cover 5. An area 15 of the inside face 16 of the bottom wall 3 around the opening 8 contains a plurality of radial grooves 17 which are in fluid communication with the opening 8 by having their inner ends opening thereto. The grooves preferably increase in cross section towards the opening 8. Branch grooves 18 extend from half of the radial grooves 17. The area 15 with the grooves 17, 18 is covered by a sieve 19 which closely overlies the grooves and against which the foam body 12 is pressed. The sieve 19 is preferably a web of synthetic material, e.g., of nylon, or a web of metal, e.g., stainless steel. Alternatively, a fleece of synthetic material or metal may be used. The pore size of the sieve 19 is considerably smaller than the pore size of the foam body 12 and is preferably between 1 and 10 $\mu$m. As a result, there is achieved an efficient filtering of the ink and, further, air bubbles are prevented from passing through the sieve 19. In this way, the bore 7 remains full of ink until all the ink contained in the foam body 12 is used up. Thus, a safer operation of the print head is achieved after exchange of a new cartridge for a used one.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. An ink cartridge for a printer comprising:

a housing including a bottom wall having a flat inner face;

an opening formed through the bottom wall with an entry end in said flat inner face;

a plurality of grooves formed on an area of said flat inner face around said entry end of said opening, the plurality of grooves being open to said entry end of said opening and extending radially from said opening in a plurality of directions;

a sieve mounted on said flat inner face and completely overlying said plurality of grooves and said opening, the sieve having a sieve pore size of between 1 $\mu$m and 10 $\mu$m; and, a porous ink storing body in the housing, said porous body being held in contact with said sieve and having a pore size larger than said sieve pore size, wherein an active area of said sieve is increased by said plurality of grooves formed on said area of said flat inner face thereby reducing ink flow resistance through the sieve.

2. The cartridge of claim 1 including additional grooves extending as branch grooves from at least some of said radially extending grooves.

3. The cartridge of claim 1 wherein the sieve is a web of synthetic material.

4. The cartridge of claim 1 wherein the sieve is a web of metal.

5. The cartridge of claim 1 wherein the sieve is a fleece.

6. The cartridge of claim 1 wherein the porous body is compressed in a direction perpendicular to the bottom wall over most of the area of the bottom wall.

7. The cartridge of claim 1 wherein the porous body is compressed by a degree of at least 2%.

8. The cartridge of claim 7 wherein the degree of compression of the porous body is not substantially greater than 6%.

9. The cartridge of claim 1 wherein the sieve is a filter having a size greater than a size of the opening, the sieve and the plurality of grooves increasing an active area from which ink is drawn to the opening.

10. The cartridge of claim 1 wherein the sieve is disposed in a plane substantially parallel to and overlying the groove in the flat inner face.

11. The cartridge of claim 1 including branch grooves extending from half of the plurality of grooves.

12. The cartridge of claim 11 wherein the branch grooves extend in an alternating pattern from every other groove.

13. An ink cartridge containing a supply of ink for a printer comprising:

a housing including a bottom wall having a flat inner surface;

an outlet opening formed on the flat inner surface and through the bottom wall;

a plurality of grooves defined by the flat inner surface which communicate with and extend out from the outlet opening and supply ink to the outlet opening, the plurality of grooves being disposed radially to the outlet opening;

a sieve mounted on the flat inner face and completely overlying. the plurality of grooves and the outlet opening, the sieve having a pore size which is greater than 1 $\mu$m and less than 10 $\mu$m; and a porous ink storing body disposed in the housing, the porous body being in contact with the sieve and having a pore size greater than the sieve pore size.

14. The ink cartridge as set forth in claim 13 wherein the sieve has an area greater than an area of the outlet opening and overlaying the plurality of grooves.

15. An ink cartridge for a printer comprising:

a housing including a bottom wall having a flat inner surface;

an outlet opening formed on the flat inner surface and through the bottom wall;

a filter on the flat inner surface; and, a plurality of grooves formed on the flat inner surface adjacent said filter and extending radially outward from the outlet opening, the plurality of grooves being disposed around the outlet opening and each of the plurality of grooves increasing in size toward the outlet opening for communicating ink from said ink storing body towards said outlet opening, the plurality of grooves providing an active area of said filter to reduce flow resistance through the filter; and, a porous ink storing body disposed in the housing, the porous body being in contact with said filter.

16. The cartridge of claim 15 including branch grooves extending from at least some of the plurality of grooves.

17. The cartridge of claim 16 wherein the branch grooves extend from half of the plurality of grooves.

18. The cartridge of claim 17 wherein the branch grooves extend in an alternating pattern from every other groove.

* * * * *